US012740615B2

(12) United States Patent
Davis

(10) Patent No.: US 12,740,615 B2
(45) Date of Patent: Sep. 22, 2026

(54) FOOTWEAR HAVING INTERNAL METATARSAL GUARD

(71) Applicant: Red Wing Shoe Company, Inc., Red Wing, MN (US)

(72) Inventor: Russell Lane Davis, Red Wing, MN (US)

(73) Assignee: Red Wing Shoe Company, Inc., Red Wing, MN (US)

( * ) Notice: Subject to any disclaimer, the term of this patent is extended or adjusted under 35 U.S.C. 154(b) by 313 days.

(21) Appl. No.: 18/297,415

(22) Filed: Apr. 7, 2023

(65) Prior Publication Data

US 2023/0380537 A1 Nov. 30, 2023

Related U.S. Application Data

(62) Division of application No. 15/673,536, filed on Aug. 10, 2017, now Pat. No. 11,622,597.

(60) Provisional application No. 62/373,020, filed on Aug. 10, 2016.

(51) Int. Cl.

| | |
|---|---|
| ***A43B 7/32*** | (2006.01) |
| ***A43B 3/02*** | (2006.01) |
| ***A43B 23/02*** | (2006.01) |

(52) U.S. Cl.

CPC ..... *A43B 7/32* (2013.01); *A43B 3/02* (2013.01); *A43B 23/026* (2013.01)

(58) Field of Classification Search

CPC ..... A43B 23/026; A43B 3/02; A43B 7/32
USPC ..... 36/96
See application file for complete search history.

(56) References Cited

U.S. PATENT DOCUMENTS

| | | | | |
|---|---|---|---|---|
| 2,392,867 | A | 1/1946 | Stoner et al. | |
| 2,615,261 | A | 10/1952 | La Grotto | |
| RE24,897 | E | 11/1960 | Schlect | |
| 3,102,347 | A | 9/1963 | Griswold et al. | |
| 3,561,142 | A | 2/1971 | Streit, Sr. et al. | |
| 3,798,804 | A | 3/1974 | Funck | |
| 3,841,004 | A | 10/1974 | Gray et al. | |
| 3,995,382 | A | 12/1976 | Smith | |
| 4,102,062 | A | 7/1978 | Adams | |
| 4,231,170 | A | 11/1980 | Griswold | |
| 4,342,159 | A * | 8/1982 | Edwards | A43C 13/14 36/77 R |
| 4,656,761 | A | 4/1987 | Lord | |
| 4,864,742 | A | 9/1989 | Grilliot et al. | |
| 4,908,963 | A | 3/1990 | Krajcir et al. | |
| 5,457,898 | A | 10/1995 | Fortin et al. | |
| 5,711,092 | A | 1/1998 | Despres et al. | |
| D396,550 | S | 8/1998 | Feldman et al. | |

(Continued)

*Primary Examiner* — Alissa J Tompkins
*Assistant Examiner* — Catherine M Ferreira
(74) *Attorney, Agent, or Firm* — Merchant & Gould P.C.

(57) ABSTRACT

The present disclosure provides footwear with an internal metatarsal guard and a related manufacturing method. In the depicted embodiment, the metatarsal guard is internal in that it is located under the outer layer of the footwear. In the depicted embodiment, the existence of the metatarsal guard can be visually detected from the outside of the footwear being that the metatarsal guard is located in a raised area in vamp of the footwear. The footwear is constructed such that the metatarsal guard does not impinge into the foot volume of the footwear, and the metatarsal protection also is arranged and configured to maintain a high degree of flexibility in the footwear.

3 Claims, 7 Drawing Sheets

(56) References Cited

U.S. PATENT DOCUMENTS

| | | | | |
|---|---|---|---|---|
| 5,878,511 | A | 3/1999 | Krajcir | |
| 5,996,257 | A | 12/1999 | Harrison | |
| 6,128,837 | A | 10/2000 | Huang | |
| 6,161,313 | A | 12/2000 | Bisson | |
| 6,170,174 | B1 | 1/2001 | Gesso | |
| 6,381,976 | B1 | 5/2002 | Kempiak et al. | |
| D472,041 | S | 3/2003 | Kuerbis | |
| 6,581,304 | B2 | 6/2003 | Mitchell | |
| 6,618,962 | B1 | 9/2003 | Covatch | |
| 6,631,569 | B1 * | 10/2003 | Scharbius | A43B 7/32 36/72 R |
| 2002/0104174 | A1 * | 8/2002 | Bartlett | A43B 7/32 12/146 D |
| 2006/0070262 | A1 | 4/2006 | Shaw et al. | |

* cited by examiner

FOOTWEAR HAVING INTERNAL METATARSAL GUARD

RELATED APPLICATIONS

This application is a divisional of U.S. patent application Ser. No. 15/673,536, filed Aug. 10, 2017, now U.S. Pat. No. 11,622,597; which claims priority of U.S. Provisional Application No. 62/373,020, filed Aug. 10, 2016, which are incorporated herein by reference in their entireties.

BACKGROUND

Footwear with metatarsal guards and protective toes are commonly used in work environments to protect the user's foot from injury due to a falling object. Metatarsal guards are either external to the footwear or internal to the footwear. External guards then to decrease the flexibility of the footwear and can be cumbersome due their size and location on and connection to the footwear. Internal guards can also decrease the flexibility of the footwear, and be difficult to visually verify their existence, and can decrease the foot fitting volume of the footwear and cause undesirable pressure points on the foot. The present disclosure is directed to footwear with an improved internal metatarsal guard.

SUMMARY

The present disclosure provides footwear with an internal metatarsal guard and a related manufacturing method. In the depicted embodiment, the metatarsal guard is internal in that it is located under the outer layer of the footwear. In the depicted embodiment, the existence of the metatarsal guard can be visually detected from the outside of the footwear being that the metatarsal guard is located in a raised area in vamp of the footwear. The footwear is constructed such that the metatarsal guard does not impinge into the foot volume of the footwear, and the metatarsal protection also is arranged and configured to maintain a high degree of flexibility in the footwear.

DETAILED DESCRIPTION

Figure 1:
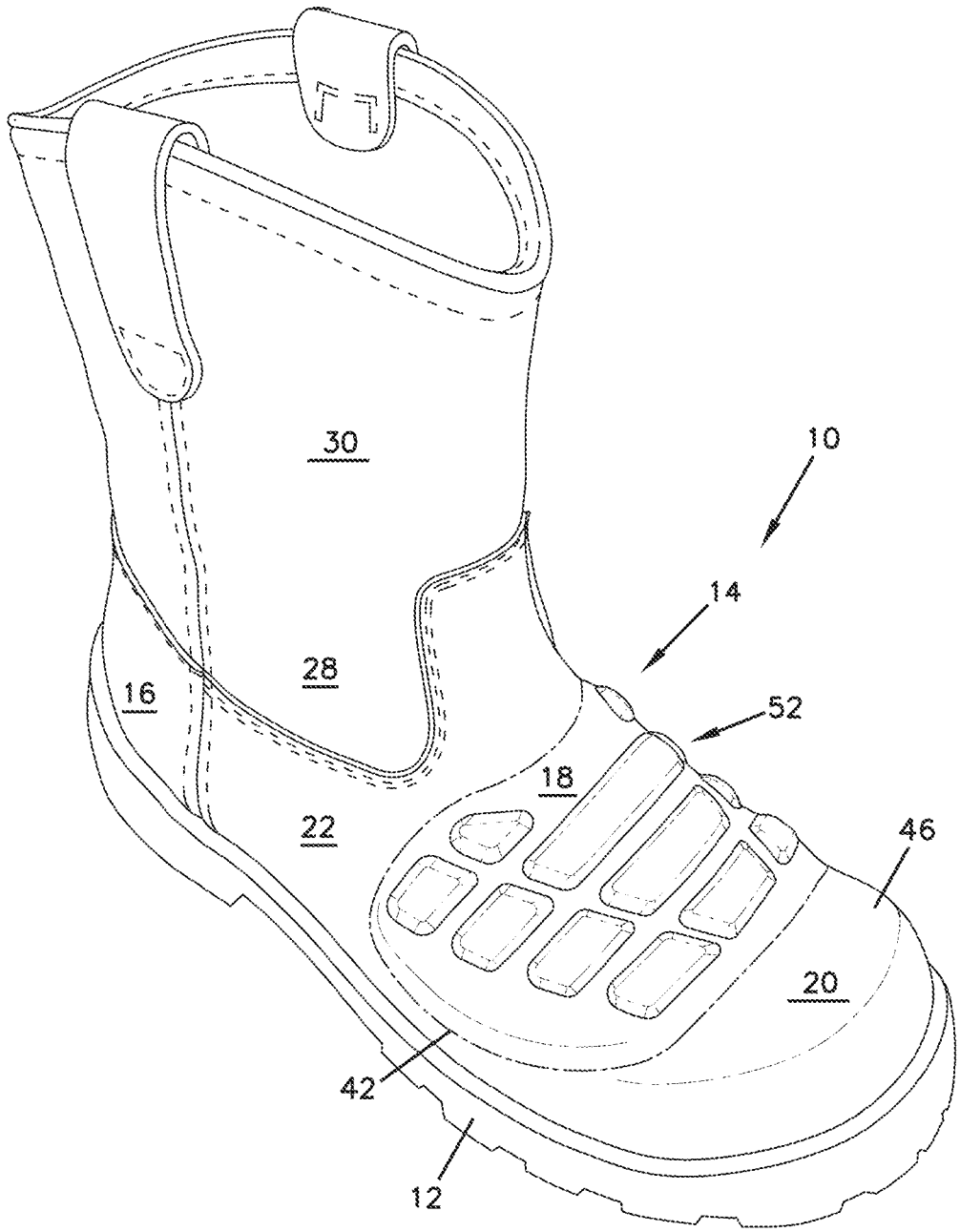
FIG. 1 is a side view of an embodiment footwear according to the principles of the present disclosure.
Figure 2:
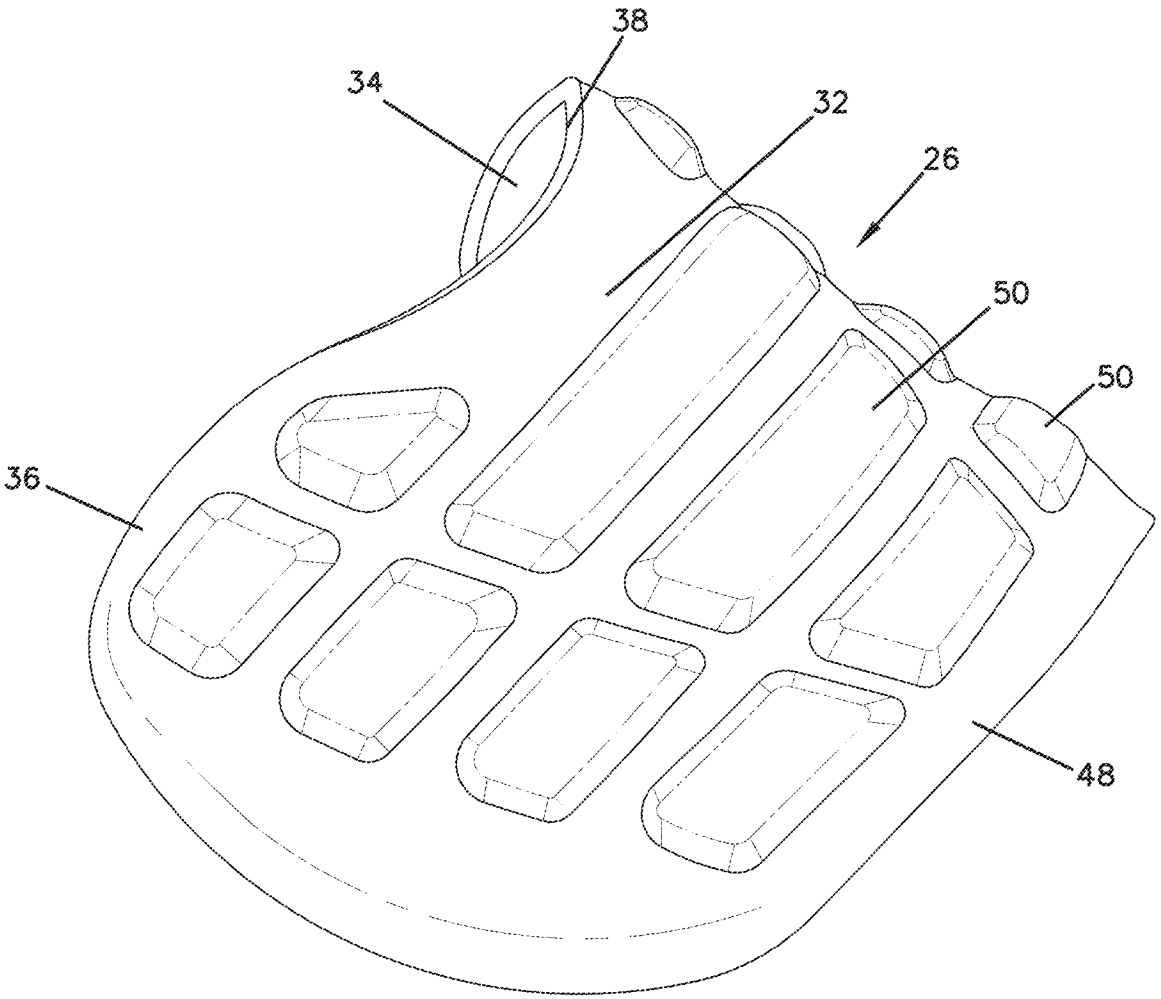
FIG. 2 is an isometric view of a component of the footwear of FIG. 1.
Figure 3:
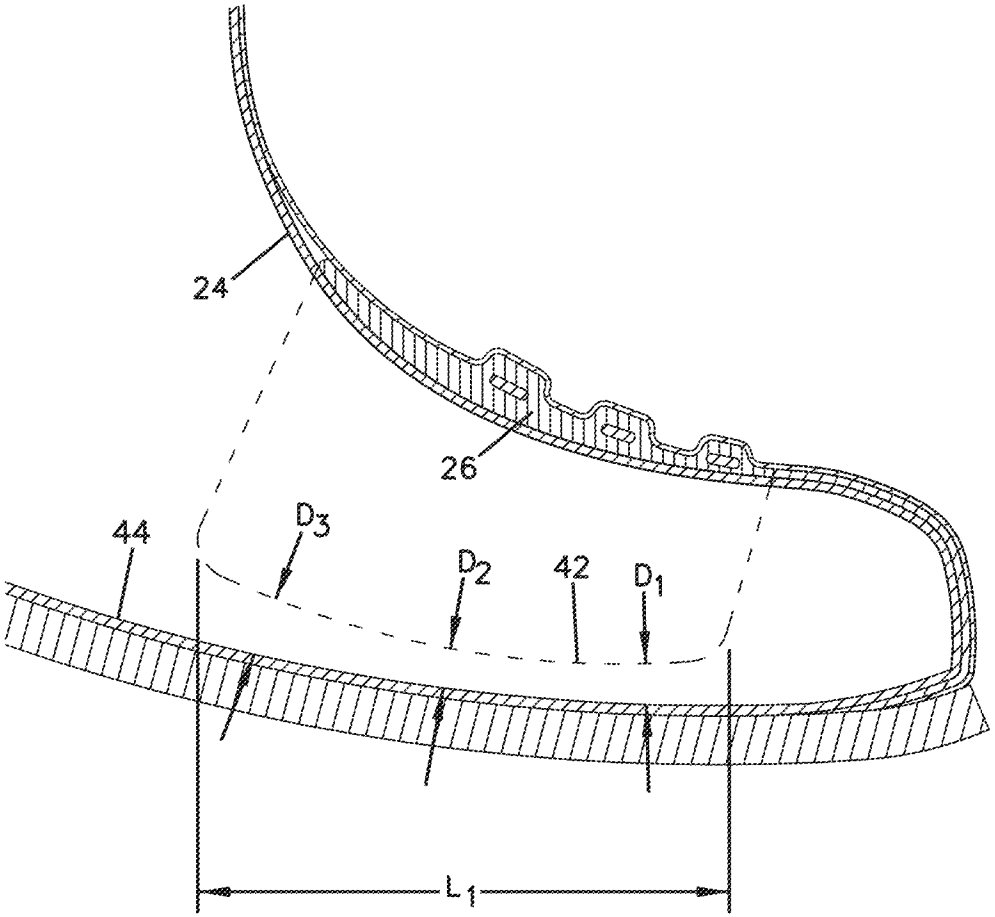
FIG. 3 is a partial cross sectional view of the footwear of FIG. 1 line 3-3.
Figure 4:
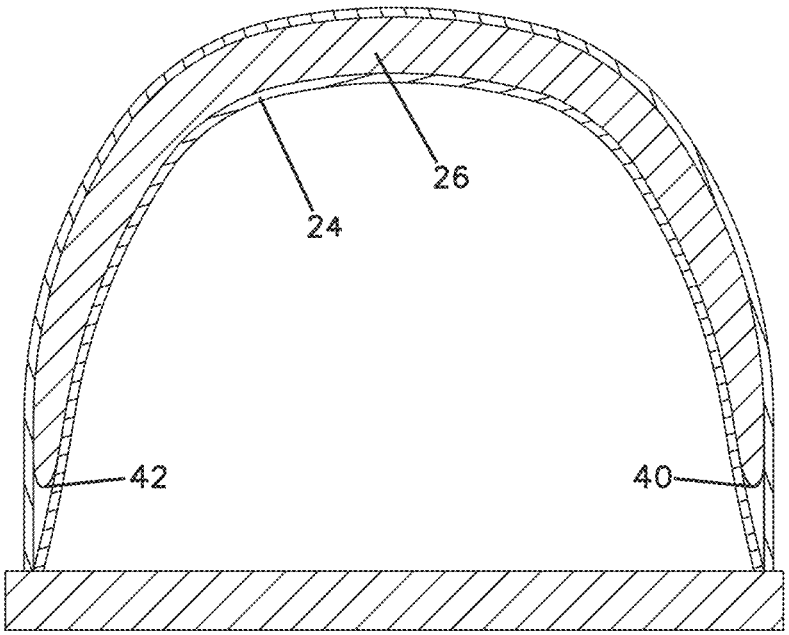
FIG. 4 is a cross sectional view of the footwear of FIG. 1 along lines 4-4.

Referring to FIGS. 1-4, an embodiment of footwear according to the present disclosure is described herein. In the depicted embodiment, the footwear 10 includes a sole 12, an upper 14 connected to the sole 12. In the depicted embodiment, the upper 14 including heel covering region 16, a metatarsal covering region 18, a toe covering region 20, an ankle covering region 28, and a lower leg covering region 30.

In the depicted embodiment, the upper 14 includes an outer layer 22. The outer layer in the depicted embodiment is leather. It should be appreciated that many other upper configurations are also possible (nylon, rubber, etc.) In the depicted embodiment the outer layer 22 defines a raised portion 52 in the metatarsal covering region. In the depicted embodiment, the raised portion 52 is formed via a debossing step wherein the outer layer is pressed into a heated mold cavity under which permanently shapes the leather. In the depicted embodiment, a number of raised ridges 50 are formed in the raised portion 52. The section of leather that includes the raised portion 52 is also referred to herein as the vamp of the footwear. In the depicted embodiment, the vamp is cut from a flat sheet of leather in a shape that can be stitched into a three dimensional body portion of the footwear. It should be appreciated that many other methods of creating a raised portion in an upper are also possible.

In the depicted embodiment, a metatarsal protector 26 is located in the raised portion of the metatarsal covering region. In the depicted embodiment, the metatarsal protector 26 is molded directed to the outer layer 22. In the depicted embodiment, molten material is injected onto the raised portion. The molten material fill into the space of the raised portion and the bottom surface is formed such that it would not impinge into the foot fitting volume of the footwear. Once cured, the material is resilient and functions as a metatarsal protector. In some embodiments the material is a foam material. In other embodiments, the material is a gel material (e.g., polyurethane gel). In the depicted embodiment, the metatarsal protector has a thickness of between 0.125 to 0.5 inches. Many alternative materials and methods can be used to form the metatarsal protector. In alternative embodiments the metatarsal protectors can be performed and then glued or stitched in into the raised portion.

In the depicted embodiment, the upper also includes an inner lining 24. In the depicted embodiment, the metatarsal protector 26 is sandwiched between the outer layer 22 and the inner lining 24. In the depicted embodiment, the inner lining can be stitched or glued to the inside surface of the outer layer 22 as well as portions of the metatarsal protector 26. In the depicted embodiment, the liner defines a foot fitting volume having a curved upper foot engaging surface which facilitate comfort and fit. In the depicted embodiment the bottom surface of the metatarsal protector 26 is anatomically shaped to facilitate fit and comfort.

In the depicted embodiment, the metatarsal protector 26 includes a middle portion 32 connected between an inside lower wing portion 34 and an outside lower wing portion 36. In the depicted embodiment, the middle portion 32 and lower wing portions 34, 36 are arranged such that the metatarsal protector includes an arched shaped cross sectional profile.

In the depicted embodiment, the metatarsal protector includes a rearward periphery edge 38 that is curved with the inside lower wing portion and outside lower wing portions extending rearward of the middle portion towards the heel region. In the depicted embodiment, the rearward periphery edge 38 of the metatarsal protector is located forward of the transition between the metatarsal covering region 18 and the ankle cover region 28.

In the depicted embodiment, a lower periphery edge 40 of the inside lower wing portion and the lower periphery edge 42 of the outside lower wing portion is between spaced away from the top edge 44 of the sole. In the depicted embodiment, the lower periphery edges 40, 44 of the inside lower wing portion and the outside lower wing portion are between 0.125 to 1.0 inches from a top edge of the sole. More particularly the lower periphery edges of the inside lower wing portion and the outside lower wing portion are between 0.25 to 0.5 inches from a top edge of the sole. In the depicted embodiment forces from an object falling unto the footwear are absorbed by the metatarsal protector and are transfer down into the sole of the footwear via the downwardly ending wings and through the side wall of the vamp. In the depicted embodiment the distance between the lower periphery edges of the wings and the upper edge of the sole allows for flexibility in the footwear as well as proper transfer of downward force to the sole. It should be appreciated that many alternative embodiments are possible.

In the depicted embodiment, the footwear 10 includes a protective toe cap 46. In the depicted embodiment, the middle portion 32 of the over laps the protective toe cap 46. In the depicted embodiment, the middle portion 32 of the metatarsal protector includes a front lip portion 48 that extend over a protective toe cap 46. In the depicted embodiment the protective cap 46 provides support for the metatarsal protector. It should be appreciated that many alternative embodiments are possible.

Figure 5:
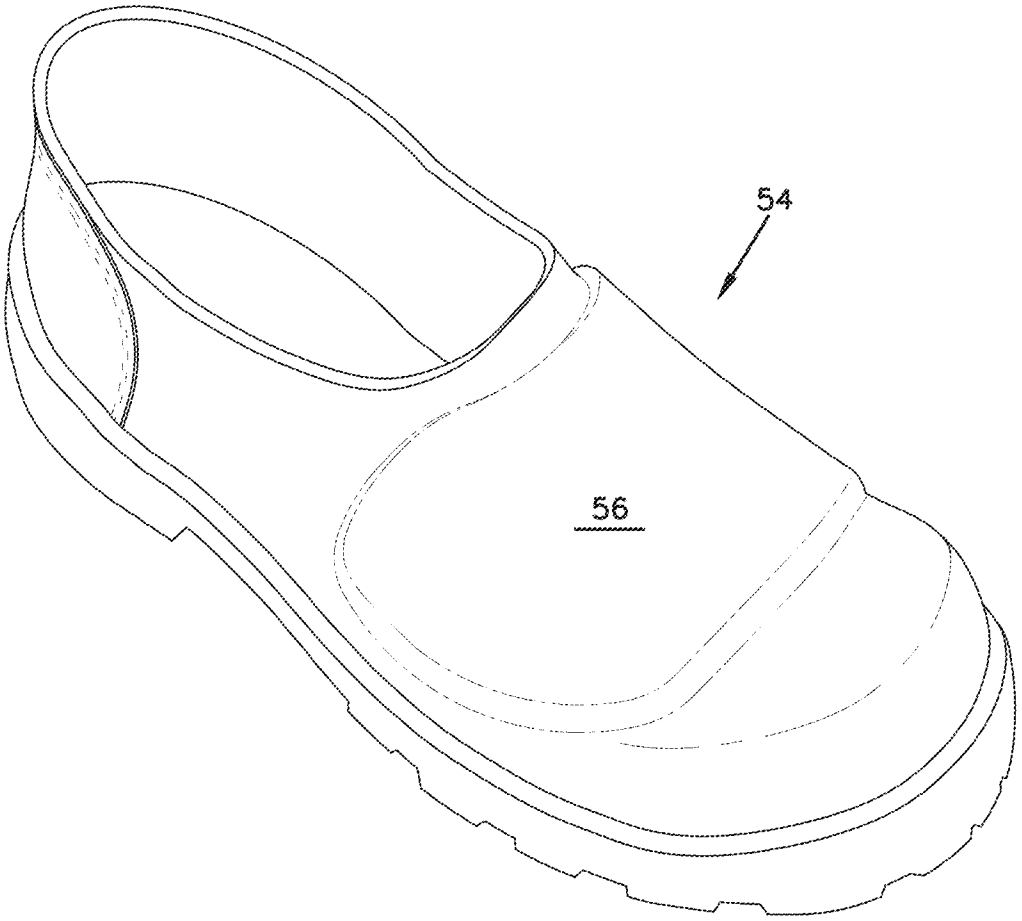
FIG. 5 is an isometric view of an alternative embodiment of the footwear of FIG. 1.
Figure 6:
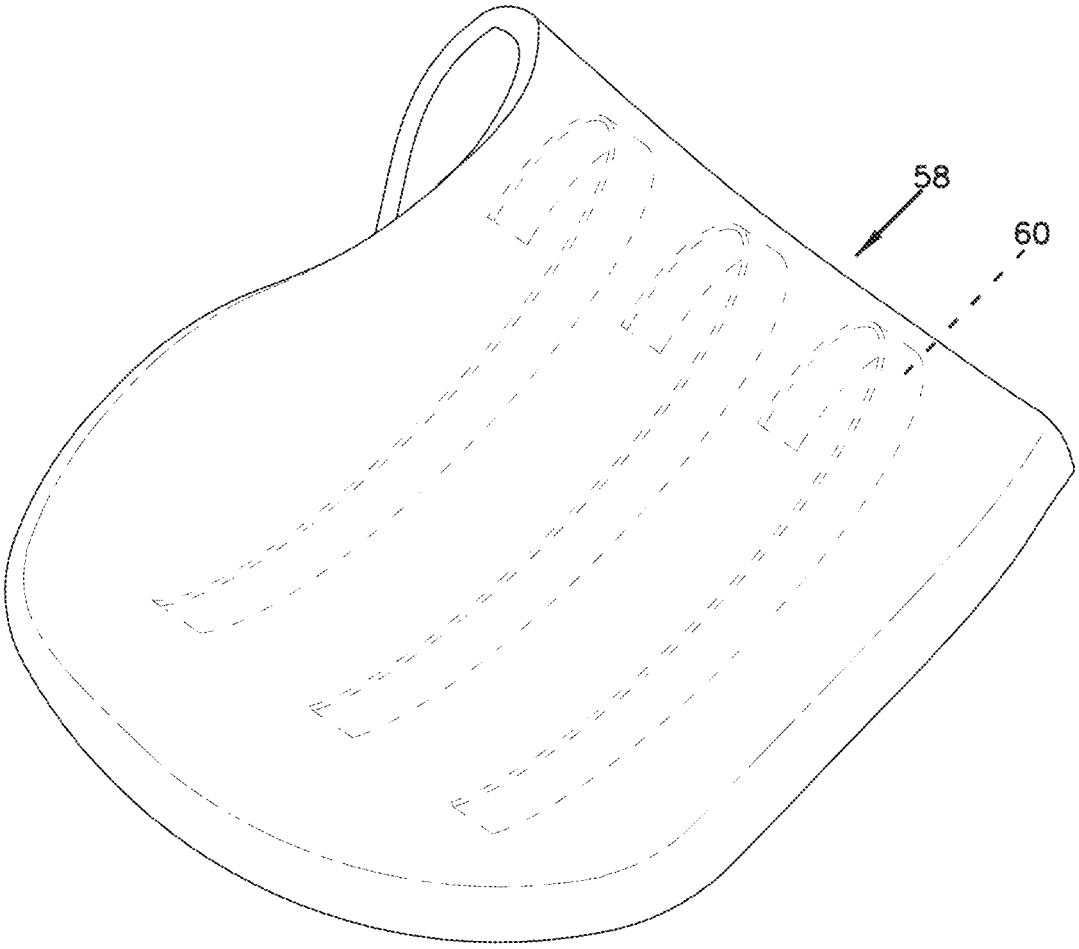
FIG. 6 is an isometric view of a component of the footwear of FIG. 5.
Figure 7:
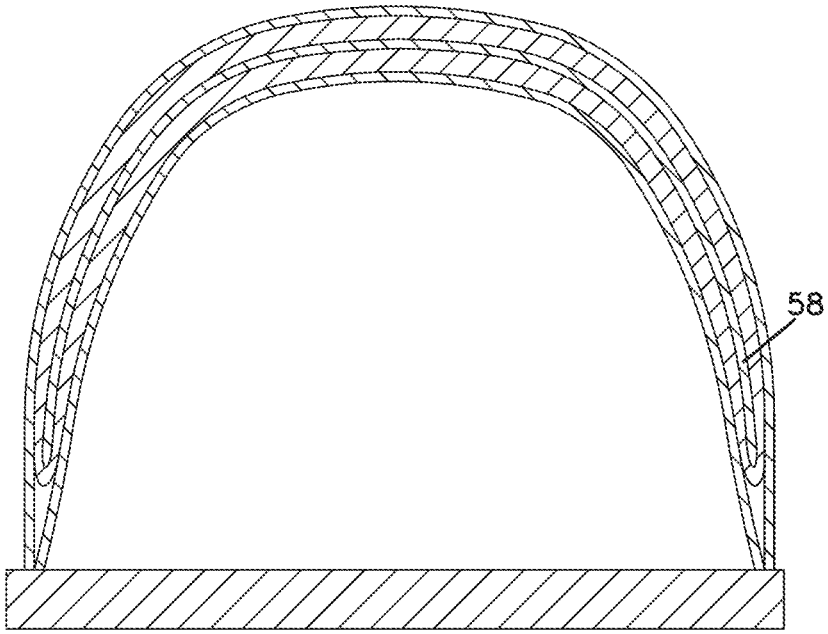
FIG. 7 is a cross sectional view of the footwear of FIG. 1 along lines 6-6.

Referring to FIGS. 5-7, an alternative embodiment of the footwear 10 is shown. In the depicted embodiment, the footwear 54 has a number of similarities and some differences with footwear 10. One of the differences is that the footwear 54 is a low top slip on the shoe whereas footwear 10 is a pull on boot. It should be appreciated that the principles of the present disclosure can be applied to shoes of many different forms (e.g., lace ankle height boots, etc.).

Another difference between the footwear 10 and the footwear 54 is that the raised portion 56 of the footwear 54 is smooth and lacks raised ridges. It should be appreciated that even without raised ridges, the raised portion 54 is visually apparent from viewing the external of the footwear and thereby indicates that the footwear has metatarsal protection therein.

It should be appreciated that the three dimensional shape of the metatarsal protector which is in part defined by the shape of the raised portion 56 can take a number of different alternative forms. Yet another difference between the footwear is that metatarsal protector 58 of the footwear 54 includes a plurality of spaced apart ribs 60 molded therein. In the depicted embodiment, the ribs 60 are arranged to provide additional structural strength to the metatarsal protector 58 while preserving the flexibility of the metatarsal protector 58 in the lengthwise direction. In the depicted embodiment the ribs are constructed of nylon. It should be appreciated that many other variations in the construction of the metatarsal protectors are also possible.

Various modifications and alterations of this disclosure will become apparent to those skilled in the art without departing from the scope and spirit of this disclosure, and it should be understood that the scope of this disclosure is not to be unduly limited to the illustrative examples set forth herein.

The invention claimed is:

1. A method of manufacturing footwear comprising:

cutting a vamp from leather;

debossing the vamp to form a recess in an inside facing surface of the vamp in a metatarsal covering region;

molding a resilient material directly into the recess in the vamp to form a metatarsal protector; and connecting a liner over the metatarsal protector such that the liner is configured to directly define a foot engaging surface of a wearer's foot within a foot fitting volume of the footwear without another intermediate structure positioned between the liner and the wearer's foot, wherein the metatarsal protector is sandwiched directly between the leather defining the vamp and the liner;

wherein the step of debossing to form the recess includes defining a middle portion of the recess and two opposed downwardly extending wings that are configured to be spaced away from a sole of the footwear such that a lower periphery edge of both of the two opposed downwardly extending wings is between 0.125 inches to 1.0 inch from a top edge of the sole.

2. The method of claim 1, wherein the resilient material is a polyurethane gel.

3. The method of claim 1, wherein the resilient material is a foam material.

* * * * *